United States Patent [19]

Sage

[11] 3,970,985

[45] July 20, 1976

[54] LINEAL CONTROLLED RESISTANCE DEVICE

[76] Inventor: William S. Sage, 1922 Grovehaven, Memphis, Tenn. 38116

[22] Filed: July 30, 1975

[21] Appl. No.: 600,439

[52] U.S. Cl. ..... 338/162; 338/118; 338/150; 338/184; 338/199; 338/202

[51] Int. Cl.[2] ..... H01C 10/32

[58] Field of Search ..... 338/162, 160, 118, 150, 338/184, 199, 202; 74/29, 31

[56] References Cited

UNITED STATES PATENTS

| | | | |
|---|---|---|---|
| 3,431,530 | 3/1969 | Bang | 338/199 X |
| 3,465,277 | 9/1969 | Bang | 338/199 X |
| 3,800,266 | 3/1974 | Murao et al. | 338/162 |

*Primary Examiner*—C. L. Albritton
*Attorney, Agent, or Firm*—John R. Walker, III

[57] ABSTRACT

A device for controlling the amount of resistance in an electric circuit. A variable resistor is fixedly attached to a carriage slidably mounted on a pair of spaced apart guide rods within a hollow frame. A pinion gear is fixedly attached to a shaft of the variable resistor for allowing the resistance of the variable resistor to be varied by rotation thereof. A rack gear is fixedly attached to the frame in engagement with the pinion gear whereby manual lineal movement of the carriage back and forth upon the guide rods will cause rotary movement of the shaft of the variable resistor thereby varying the resistance of the variable resistor.

10 Claims, 4 Drawing Figures

LINEAL CONTROLLED RESISTANCE DEVICE

BACKGROUND OF THE INVENTION

1. Field of the Invention

This invention relates to linear controlled resistance means for controlling the amount of resistance in an electric circuit.

2. Description of the Prior Art

Variable resistors are used in the electrical field for various applications such as controlling the volume of audio equipment. It is well known by persons skilled in the variable resistor art that lineal controlled variable resistors offer the advantages of ease of manipulation and of quick identification of the amount of resistance of the resistor while rotary controlled variable resistors offer the advantage of ease of fine adjustment. As evidenced by Chantemerle, U.S. Pat. No. 1,351,023; Miyashita, U.S. Pat. No. 3,743,999; and Murao et al., U.S. Pat. No. 3,800,266, variable resistor units which combine the advantages of both lineal and rotary controlled variable resistors have been developed. None of these patents disclose or suggest the present invention.

The known variable resistor units which combine the advantages of both lineal and rotary controlled variable resistors have not proved entirely satisfactory because of various reasons. In Chantemerle, a plunger coacts with the shaft of a rotary controlled variable resistor so that when the plunger is moved in and out, the resistance of the rotary controlled variable resistor will be varied. This device is not entirely satisfactory since identification of the amount of resistance being applied depends upon how far the plunger extends past the shaft which does not lend itself to quick determination. In Miyashita, a lever is pivotally mounted to the frame of a variable resistor unit. One end of the lever coacts with the shaft of a rotary controlled variable resistor so that when the lever is moved up and down, the resistance of the rotary controlled variable resistor will be varied. This device is not entirely satisfactory since the maximum amount the resistance can be varied depends upon the maximum amount the lever is capable of pivoting which is limited. In Murao et al, a rotary controlled variable resistor is slidably mounted to the frame of a variable resistor unit. A pulley is attached to the shaft of the rotary controlled variable resistor. A string is affixed to the pulley and to the frame in such a way that back and forth movement of the variable resistor within the frame will cause the resistance of the rotary controlled variable resistor to be varied. This device is not entirely satisfactory since the string-and-pulley arrangement of control is somewhat unreliable.

SUMMARY OF THE INVENTION

The present invention is directed toward overcoming the problems and disadvantages of prior variable resistor units which attempt to combine the advantages of both linear and rotary controlled variable resistors. The concept of the present invention is to provide a linear controlled resistance means which utilizes a rotary controlled resistor and which is inexpensive to manufacture, reliable, smooth working, and long lasting.

The linear controlled resistance means of the present invention includes a body means, a guide rod means fixedly attached to the body means, carriage means slidably mounted to the guide rod means, variable resistor means fixedly attached to the carriage means having a rotatable shaft for varying the resistance thereof, a pinion gear fixedly attached to the rotatable shaft of the variable resistor means, a rack gear fixedly attached to the body means in engagement with the pinion gear whereby manual linear movement of the carriage means back and forth upon the guide rod means will cause rotary movement of the shaft of the variable resistor means thereby varying the resistance of the variable resistor means, and terminal means attached to the variable resistor means for connecting the variable resistor means in an electric circuit. The linear controlled resistance means of the present invention may include means for maintaining the rack gear in engagement with the pinion gear and tension means for controlling the friction between the carriage means and the guide rod means.

DESCRIPTION OF THE PREFERRED EMBODIMENT

Figure 1:
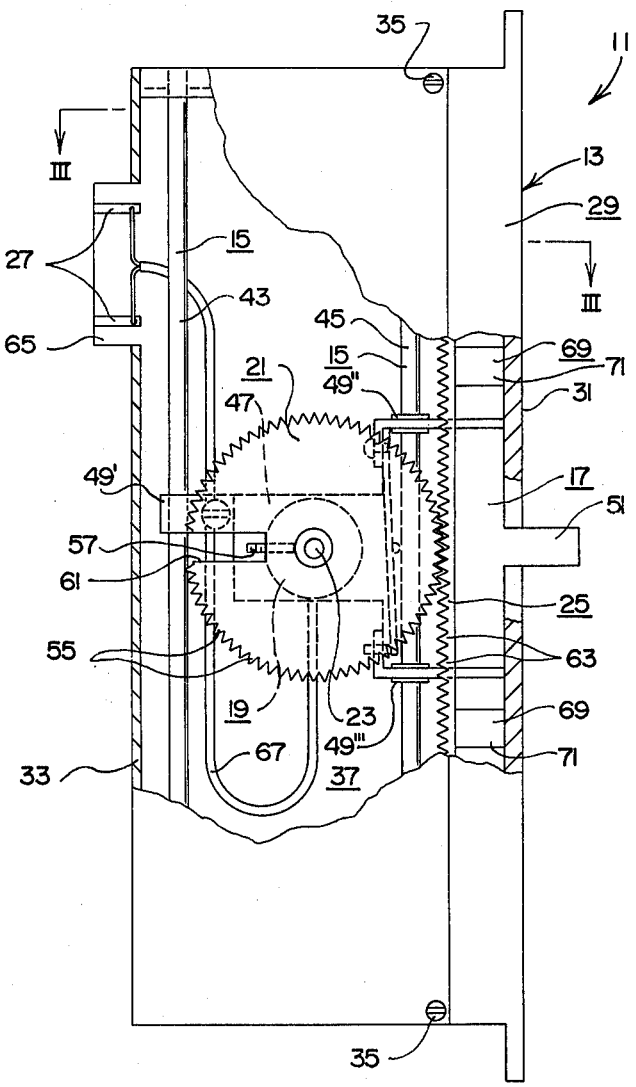
FIG. 1 is a side elevational view of the lineal controlled resistance device of the present invention with some parts broken away to show the internal structure of the device.
Figure 2:
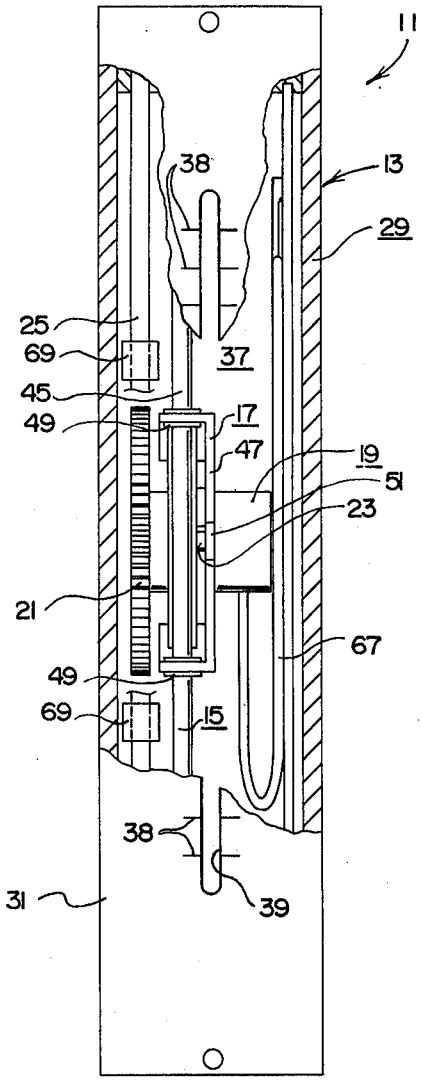
FIG. 2 is a front elevational view of the lineal controlled resistance device of the present invention with some parts broken away to show the internal structure of the device.
Figure 3:
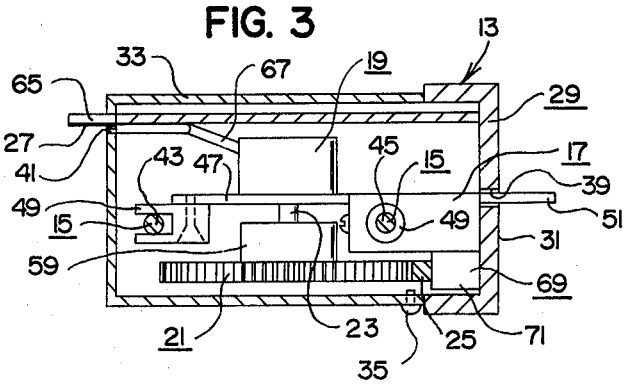
FIG. 3 is a sectional view of the lineal controlled resistance device of the present invention as taken on line III—III of FIG. 1.
Figure 4:
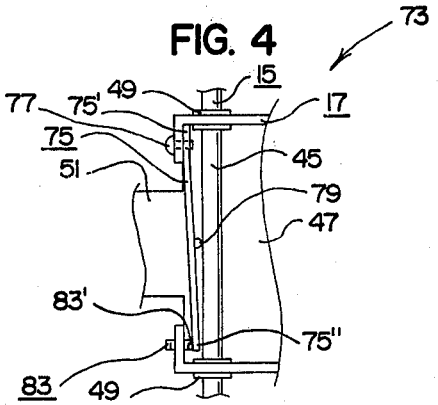
FIG. 4 is a side elevational view of the tension means of the lineal controlled resistance device of the present invention.

The linear controlled resistance means 11 of the present invention is for controlling the amount of resistance in an electric circuit (not shown). The linear controlled resistance means 11 includes, in general, a body means 13, guide rod means 15 fixedly attached to the body means 13, carriage means 17 slidably mounted on the guide rod means 15, rotary controlled variable resistor means 19 fixedly attached to the carriage means 17, a pinion gear 21 fixedly attached to a rotatable shaft 23 of the variable resistor means 19, a rack gear 25 fixedly attached to the body means 13 in engagement with the pinion gear 21 whereby manual linear movement of the carriage means 17 back and forth upon the guide rod means 15 will cause rotary movement of the shaft 23 of the variable resistor means 19 thereby varying the resistance of the variable means 19, and terminal means 27 attached to the variable resistor means 19 for connecting the variable resistor means 19 in an electric circuit.

The body means 13 preferably includes a frame 29 having a face panel 31, and a cover 33 removably attached to the frame 29 by means such as screws 35 or the like. The frame 29 and cover 33 of the body means 13 coact with one another to form a hollow interior portion 37 of the body means 13. The face panel 31 is preferably provided with indicia markings 38 and with a slit-like aperture 39 therein for reasons which will hereinafter become apparent. Likewise, the cover 33 is preferably provided with an aperture 41 for reasons which will hereinafter become apparent.

The guide rod means 15 preferably includes a pair of spaced apart guide rods fixedly attached to the body means 13. More specifically, the guide rod means 15 preferably includes a first guide rod 43 fixedly attached to the frame 29 and includes a second guide rod 45 fixedly attached to the frame 29. The first and second guide rods 43, 45 are spaced apart from one another and are arranged parallel to the slit-like aperture 39 in the face panel 31 of the body means 13.

The carriage means 17 preferably includes a body portion 47 and a plurality of bearing members 49 slidably mounting the body portion 47 to the guide rod means 15 to allow the carriage means 17 to freely slide upon the guide rod means 15. More specifically, the carriage means 17 include a first bearing member 49′ for slidably mounting the body portion 47 to the first guide rod 43 and may include second and third bearing members 49′, 49‴ for slidably mounting the body portion 47 to the second guide rod 45. The plurality of bearing members 49 are preferably constructed of a substantially frictionless material such as plastic or the like. The body portion 47 of the carriage means 17 is preferably provided with an arm 51 for extending through the slit-like aperture 39 in the face panel 31 of the body means 13 whereby manual linear movement of the arm 51 back and forth within the slit-like aperture 39 of the body means 13 will cause corresponding back and forth lineal movement of the carriage means 17 upon the guide rod means 15.

The rotary controlled variable resistor means 19 is of any construction well known to those skilled in the art. The variable resistor means 19 may be fixedly attached to the body portion 47 of the carriage means 17 in any manner well known to those skilled in the art.

The pinion gear 21 may be of any well known construction having a plurality of teeth 55 around its periphery. The pinion gear 21 may be fixedly attached to the shaft 23 of the variable resitor means 19 in any number of ways well known to those skilled in the art. For example, the pinion gear 21 may be attached to the shaft 23 by way of a set screw 57. When the pinion gear 21 is attached to the shaft 23 by way of the set screw 57, the pinion gear 21 is preferably provided with a boss portion 59. In addition, the pinion gear 21 may be provided with a cut-out section 61 to allow easy access to the set screw 57.

The rack gear 25 may be of any well-known construction having a plurality of teeth 63 of a size for coacting with the teeth 55 of the pinion gear 21. The rack gear 25 is preferably fixedly attached to the frame 29 in any manner well known to those skilled in the art. More specifically, the rack gear 25 is attached to the body means 13 in such a position to allow the teeth 55 of the pinion gear 21 and the teeth 63 of the rack gear 25 to coact with one another whereby lineal movement of the arm 51 of the carriage means 17 back and forth within the slit-like aperture 39 of the body means 13 will cause rotary movement of the shaft 23 of the variable resistor means 19 thereby varying the resistance of the variable resistor means 19.

The terminal means 27 may be of any well-known construction. Preferably, the terminal means 27 projects through the aperture 41 in the cover 33 of the body portion 13 to allow the variable resistor means 19 to be easily connected to the electric circuit. More specifically, the terminal means 27 may be mounted on a support member 65 at a location which allows the terminal means 27 to project through the aperture 41 in the cover 33 of the body means 13. The support member 65 is preferably fixedly attached to the frame portion 29 of the body means 13. A flexible electrical conductor 67 is provided to connect the variable resistor means 19 to the electrical circuit by way of the terminal means 27 while allowing the variable resistor means 19 to move back and forth upon the guide rod means 15 with the carriage means 17 while maintaining an electrical connection with the terminal means 27.

It should be noted that the rack gear 25 is preferably constructed in such a manner that it will freely bow away from the pinion gear 21 to prevent the pinion gear 21 and rack gear 25 from binding to one another and to allow smooth coaction between the pinion gear 21 and rack gear 25. However, to maintain the rack gear 25 in engagement with the pinion gear 21, the linear controlled resistance means 11 preferably includes means 69. The means 69 preferably includes at least one and preferably a plurality of spring-like members 71 for forcing the rack gear 25 into engagement with the pinion gear 21. It should be noted that the spring-like members 71 may be comprised of blocks of foam rubber or the like.

The linear controlled resistance means 11 may include a tension means 73 for controlling the friction between the carriage means 17 and the guide rod means 15. The tension means 73 preferably includes an elongated spring-like member 75 extending substantially parallel to the second guide rod 45. The elongated spring-like member 75 is provided with a first end 75′ and a second end 75″. The first end 75′ of the elongated spring-like member 75 is fixedly attached to the body portion 47 of the carriage means 17 by any means well known to those skilled in the art such as the screw 77. The tension means 73 also includes a ball-like member 79 positioned between the spring-like member 75 and the second guide rod 45. The elongated spring-like member 75 is preferably provided with an aperture, indent or the like (not shown) intermediate the first and second ends 75′, 75″ thereof to help retain the ball-like member 79 between the spring-like member 75 and the second guide rod 41 in a manner well known to those skilled in the art. The tension means 73 also includes a screw member 83 mounted on the body portion 47 of the carriage means 17 in contacting engagement with the second end 75″ of the spring-like member 75 whereby adjustment of the screw member 83 will vary the pressure the spring-like member 75 applies to the ball-like member 79 thereby varying the friction between the carriage means 17 and the guide rod means 15. That is, the screw member 83 includes end 83′ for abutting against the second end 75″ of the elongated spring-like member 75 so that when the screw member 83 is adjusted, the position of the second end 75″ of the spring-like member 75 will be varied thereby varying the pressure the spring-like member 75 applies to the ball-like member 79 and thereby varying the friction between the carriage means 17 and the guide rod means 15. It should be noted that the screw member 83 can be easily adjusted when the cover 33 is removed from the frame portion 29 of the body means 13.

The operation of the linear controlled resistance means 11 of the present invention is quite simple. First, the terminal means 27 is attached to the circuit. Next, the arm 51 is moved to the desired resistance value as evidenced by the indicia markings 38 on the face panel 31. As the arm 51 is moved, the pinion gear 21 will move and the rack gear 25 will cause the pinion gear 21 to rotate thereby rotating the shaft 23 of the variable resistor means 19 and thereby varying the resistance of the variable resistor means 19.

It should be noted that when the present invention is referred to as a "linear" controlled resistance means, reference is being made to the linear mechanical movement which controls the variable resistor means 19. The variable resistor means 19 can be of any taper such as linear, logarithmic or the like in a manner well known to those skilled in the art.

As thus constructed and operated, the present invention provides a linear controlled resistance means which among other things, combines the advantages of linear and rotary controlled variable resistors, is inexpensive to manufacture, is extremely reliable and long-lasting, and is smooth operating.

Although the invention has been described and illustrated with respect to a preferred embodiment thereof, it is not to be so limited since changes and modifications may be made therein which are within the full intended scope of the invention. I claim:

1. Linear controlled resistance means for controlling the amount of resistance in an electric circuit, said resistance means comprising:

a. body means;

b. guide rod means fixedly attached to said body means;

c. carriage means slidably mounted on said guide rod means;

d. variable resistor means fixedly attached to said carriage means, said variable resistor means including a shaft for allowing the resistance of said variable resistor means to be varied by rotary movement thereof;

e. a pinion gear fixedly attached to said shaft of said variable resistor means;

f. a rack gear fixedly attached to said body means in engagement with said pinion gear whereby manual linear movement of said carriage means back and forth upon said guide rod means will cause rotary movement of said shaft of said variable resistor means thereby varying the resistance of said variable resistor means; and g. terminal means attached to said variable resistor means for connecting said variable resistor means to the electric circuit.

2. The linear controlled resistance means of claim 1 in which said guide rod means includes a pair of spaced apart guide rods fixedly attached to said body means, and in which said carriage means includes a plurality of bearing members for mounting said carriage means to said pair of spaced apart guide rods and for allowing said carriage means to freely slide upon said pair of spaced apart guide rods.

3. The linear controlled resistance means of claim 1 in which is included means for maintaining said rack gear in engagement with said pinion gear, said means for maintaining said rack gear in engagement with said pinion gear including at least one spring-like member for forcing said rack gear into engagement with said pinion gear.

4. The linear controlled resistance means of claim 2 in which is included tension means for controlling the friction between said carriage means and said guide rod means; said tension means including an elongated spring-like member extending substantially parallel to one of said pair of spaced apart guide rods and having first and second ends with said first end fixedly attached to said carriage means, a ball-like member positioned between said spring-like member and said one of said pair of spaced apart guide rods, and a screw member mounted on said carriage means in contacting engagement with said second end of said spring-like member whereby adjustment of said screw member will vary the pressure said spring-like member applies to said ball-like member thereby varying the friction between said carriage means and said guide rod means.

5. Linear controlled resistance means for controlling the amount of resistance in an electric circuit, said resistance means comprising:

a. body means including a hollow interior portion and a face panel having a slit-like aperture therein;

b. a pair of spaced apart guide rods fixedly attached to said body means and located within said hollow interior portion of said body means parallel to said slit-like aperture in said face panel thereof;

c. carriage means slidably mounted on said pair of spaced apart guide rods, said carriage means including a plurality of bearing members for allowing said carriage means to freely slide upon said spaced apart guide rods, said carriage means including a body portion having an arm extending through said slit-like aperture of said face panel of said hollow interior portion of said body means whereby manual linear movement of said arm back and forth within said slit-like aperture of said body means will cause corresponding back and forth linear movement of said carriage means upon said spaced apart guide rods;

d. variable resistor means fixedly attached to said body portion of said carriage means, said variable resistor means including a shaft for allowing the resistance of said variable resistor means to be varied by rotary movement thereof;

e. a pinion gear fixedly attached to said shaft of said variable resistor means;

f. a rack gear fixedly attached to said body means and located within said hollow interior portion of said body means in engagement with said pinion gear with linear movement of said arm of said carriage means back and forth within said slit-like aperture of said body means causing rotary movement of said shaft of said variable resistor means thereby varying the resistance of said variable resistor means;

g. means for maintaining said rack gear in engagement with said pinion gear;

h. tension means for controlling the friction between said carriage means and said guide rods; and i. terminal means attached to said variable resistor means for connecting said variable resistor means to the electric circuit.

6. The linear controlled resistance means of claim 5 in which said means for maintaining said rack gear in engagement with said pinion gear includes at least one spring-like member for forcing said rack gear into engagement with said pinion gear.

7. The linear controlled resistance means of claim 5 in which said tension means includes an elongated spring-like member extending substantially parallel to one of said pair of spaced apart guide rods and having first and second ends with said first end fixedly attached to said body portion of said carriage means, a ball-like member positioned between said spring-like member and said one of said pair of spaced apart guide rods, and a screw member mounted on said body portion of said carriage means in contacting engagement with said second end of said spring-like member whereby adjustment of said screw member will vary the pressure said spring-like member applies to said ball-like member thereby varying the friction between said carriage means and said guide rods.

8. An improvement in a linear controlled resistance means including a body, guide rod means fixedly attached to the body, carriage means slidably mounted on the guide rod means, variable resistor means fixedly attached to the carriage means and having a shaft for allowing the resistance of the variable resistor means to be varied by rotary movement thereof, and means for causing linear movement of the carriage means to produce rotation of the shaft of the variable resistor means; said improvement comprising:

a. a pinion gear fixedly attached to the shaft of the variable resistor means; and b. a rack gear fixedly attached to the body in engagement with said pinion gear with manual linear movement of the carriage means back and forth upon the guide rod means causing rotary movement of the shaft of the variable resistor means thereby varying the resistance of the variable resistor means.

9. The improvement of claim 8 in which said improvement includes means for maintaining said rack gear in engagement with said pinion gear; said means for maintaining said rack gear in engagement with said pinion gear including spring-like means for forcing said rack gear into engagement with said pinion gear.

10. The inprovement of claim 9 in which said improvement includes tension means for controlling the friction between the carriage means and the guide rod means; said tension means including an elongated spring-like member extending substantially parallel to said guide rod means and having first and second ends with said first end fixedly attached to the carriage means, a ball-like member positioned between said spring-like member and the guide rod means, and a screw member mounted on the carriage means in contacting engagement with said second end of said spring-like member whereby adjustment of said screw member will vary the pressure said spring-like member applies to said ball-like member thereby varying the friction between the carriage means and the guide rod means.

* * * * *